US006182304B1

(12) United States Patent
Freeberg

(10) Patent No.: US 6,182,304 B1
(45) Date of Patent: Feb. 6, 2001

(54) BATHING TRANSFER APPARATUS

(76) Inventor: Frans V. Freeberg, R.D. #3, Box 200A, Shelocta, PA (US) 15774

( * ) Notice: Under 35 U.S.C. 154(b), the term of this patent shall be extended for 0 days.

(21) Appl. No.: 09/502,296

(22) Filed: Feb. 11, 2000

(51) Int. Cl.[7] ..... A47K 3/12
(52) U.S. Cl. ..... 4/560.1; 4/578.1
(58) Field of Search ..... 4/560.1, 571.1, 4/578.1, 579, 254

(56) References Cited

U.S. PATENT DOCUMENTS

| | | | | |
|---|---|---|---|---|
| 2,648,849 | * | 8/1953 | Webb et al. | 4/560.1 |
| 4,168,549 | * | 9/1979 | Davies | 4/578.1 |
| 4,253,203 | * | 3/1981 | Thomas | 4/560.1 |
| 4,359,791 | * | 11/1982 | Thomas | 4/560.1 |
| 5,373,591 | * | 12/1994 | Myers | 4/560.1 |
| 5,940,905 | * | 8/1999 | Cheng | 4/560.1 |
| 6,039,403 | * | 3/2000 | Hargroder | 4/578.1 |

* cited by examiner

*Primary Examiner*—Charles R. Eloshway

(57) ABSTRACT

A bathing transfer apparatus for transferring a person into and out of a bathing device. The bathing transfer apparatus includes a pair of supports. Each of the supports is generally U-shaped and has a two legs and base portion. A pair of rails is each elongate. Each of the rails is fixedly coupled to one of the base portions. The pair of rails define a track. A pair of securing means releasably secures the support portions to a bathing device. Each of the securing means is fixedly coupled to a bar extending between the pair of rails. A chair device includes a seat portion having a top side, a bottom side, a front edge and a back edge and a back support portion, which is fixedly coupled to the back edge of the seat portion. A plurality of wheel assemblies for rolling on the rails is fixedly coupled to the bottom side of the seat portion. The wheel assemblies are positioned such that the wheel assemblies are in communication with the rails.

6 Claims, 2 Drawing Sheets

BATHING TRANSFER APPARATUS

BACKGROUND OF THE INVENTION

1. Field of the Invention

The present invention relates to transfer devices and more particularly pertains to a new bathing transfer apparatus for transferring a person into and out of a bathing device.

2. Description of the Prior Art

The use of transfer devices is known in the prior art. More specifically, transfer devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,373,591; 4,168,549; 5,558,022; 2,648,,849; 4,941,218; and U.S. Des. Pat. No. 375,638.

While these devices fulfill their respective, particular objectives and requirements, the aforementioned patents do not disclose a new bathing transfer apparatus. The inventive device includes a pair of supports. Each of the supports is generally U-shaped and has a two legs and base portion. A pair of rails is each elongate. Each of the rails is fixedly coupled to one of the base portions. The pair of rails defines a track. A pair of securing means releasably secures the support portions to a bathing device. Each of the securing means is fixedly coupled to a bar extending between the pair of rails. A chair device includes a seat portion having a top side, a bottom side, a front edge and a back edge and a back support portion, which is fixedly coupled to the back edge of the seat portion. A plurality of wheel assemblies for rolling on the rails is fixedly coupled to the bottom side of the seat portion. The wheel assemblies are positioned such that the wheel assemblies are in communication with the rails.

In these respects, the bathing transfer apparatus according to the present invention substantially departs from the conventional concepts and designs of the prior art, and in so doing provides an apparatus primarily developed for the purpose of transferring a person into and out of a bathing device.

SUMMARY OF THE INVENTION

In view of the foregoing disadvantages inherent in the known types of transfer devices now present in the prior art, the present invention provides a new bathing transfer apparatus construction wherein the same can be utilized for transferring a person into and out of a bathing device.

The general purpose of the present invention, which will be described subsequently in greater detail, is to provide a new bathing transfer apparatus apparatus and method which has many of the advantages of the transfer devices mentioned heretofore and many novel features that result in a new bathing transfer apparatus which is not anticipated, rendered obvious, suggested, or even implied by any of the prior art transfer devices, either alone or in any combination thereof.

To attain this, the present invention generally comprises a pair of supports. Each of the supports is generally U-shaped and has a two legs and base portion. A pair of rails is each elongate. Each of the rails is fixedly coupled to one of the base portions. The pair of rails defines a track. A pair of securing means releasably secures the support portions to a bathing device. Each of the securing means is fixedly coupled to a bar extending between the pair of rails. A chair device includes a seat portion having a top side, a bottom side, a front edge and a back edge and a back support portion, which is fixedly coupled to the back edge of the seat portion. A plurality of wheel assemblies for rolling on the rails is fixedly coupled to the bottom side of the seat portion. The wheel assemblies are positioned such that the wheel assemblies are in communication with the rails.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bathing transfer apparatus apparatus and method which has many of the advantages of the transfer devices mentioned heretofore and many novel features that result in a new bathing transfer apparatus which is not anticipated, rendered obvious, suggested, or even implied by any of the prior art transfer devices, either alone or in any combination thereof.

It is another object of the present invention to provide a new bathing transfer apparatus which may be easily and efficiently manufactured and marketed.

It is a further object of the present invention to provide a new bathing transfer apparatus which is of a durable and reliable construction.

An even further object of the present invention is to provide a new bathing transfer apparatus which is susceptible of a low cost of manufacture with regard to both materials and labor, and which accordingly is then susceptible of low prices of sale to the consuming public, thereby making such bathing transfer apparatus economically available to the buying public.

Still yet another object of the present invention is to provide a new bathing transfer apparatus which provides in the apparatuses and methods of the prior art some of the advantages thereof, while simultaneously overcoming some of the disadvantages normally associated therewith.

Still another object of the present invention is to provide a new bathing transfer apparatus for transferring a person into and out of a bathing device.

Yet another object of the present invention is to provide a new bathing transfer apparatus which includes a pair of supports. Each of the supports is generally U-shaped and has a two legs and base portion. A pair of rails is each elongate. Each of the rails is fixedly coupled to one of the base portions. The pair of rails define a track. A pair of securing means releasably secures the support portions to a bathing device. Each of the securing means is fixedly coupled to a bar extending between the pair of rails. A chair device includes a seat portion having a top side, a bottom side a front edge and a back edge and a back support portion, which is fixedly coupled to the back edge of the seat portion. A plurality of wheel assemblies for rolling on the rails is fixedly coupled to the bottom side of the seat portion. The wheel assemblies are positioned such that the wheel assemblies are in communication with the rails.

Still yet another object of the present invention is to provide a new bathing transfer apparatus that has a slidably securing means for adjustment with relation to the bathing device used.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
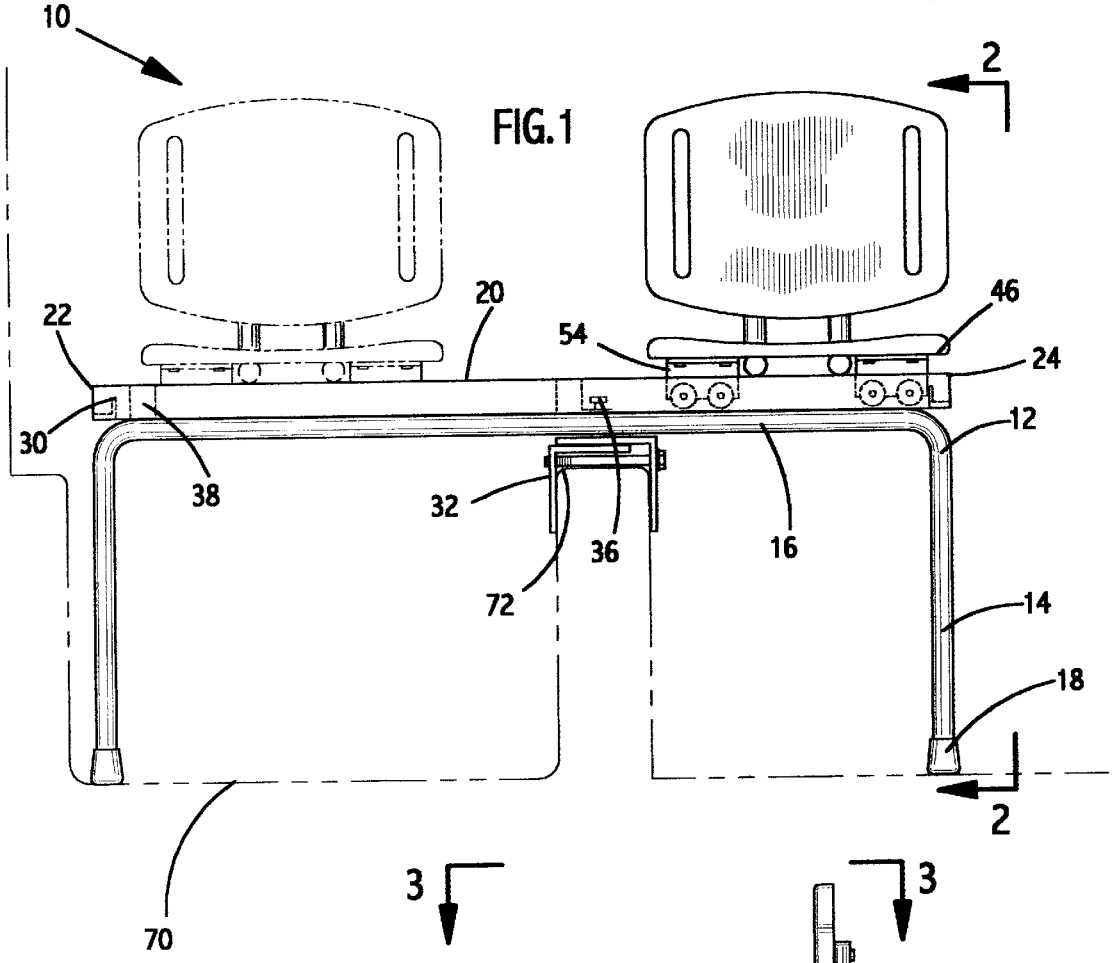
FIG. 1 is a schematic front view of a new bathing transfer apparatus according to the present invention.
Figure 2:
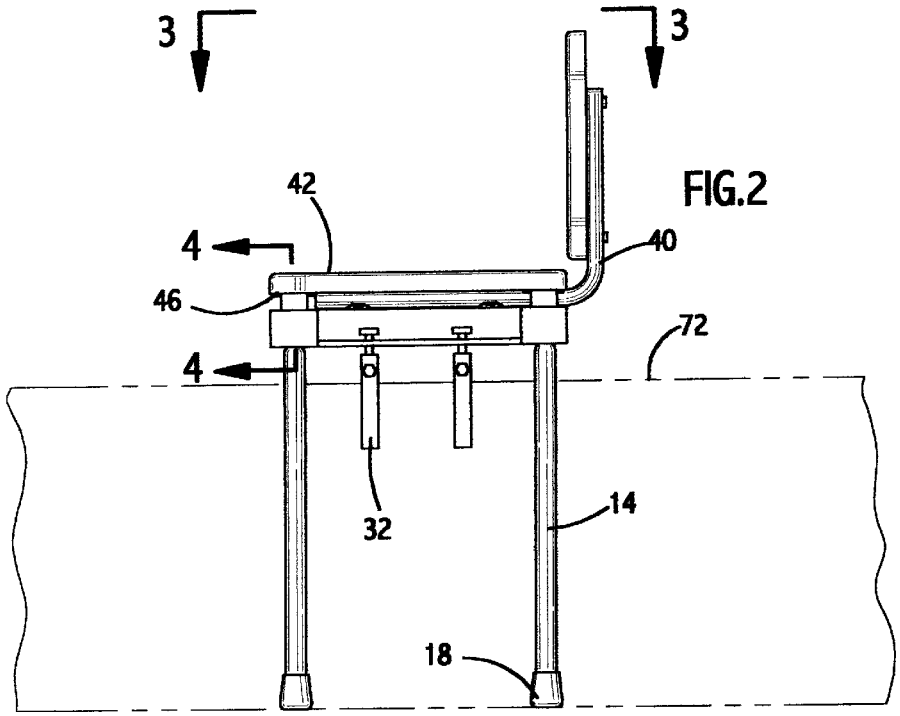
FIG. 2 is a schematic side view of the present invention.
Figure 3:
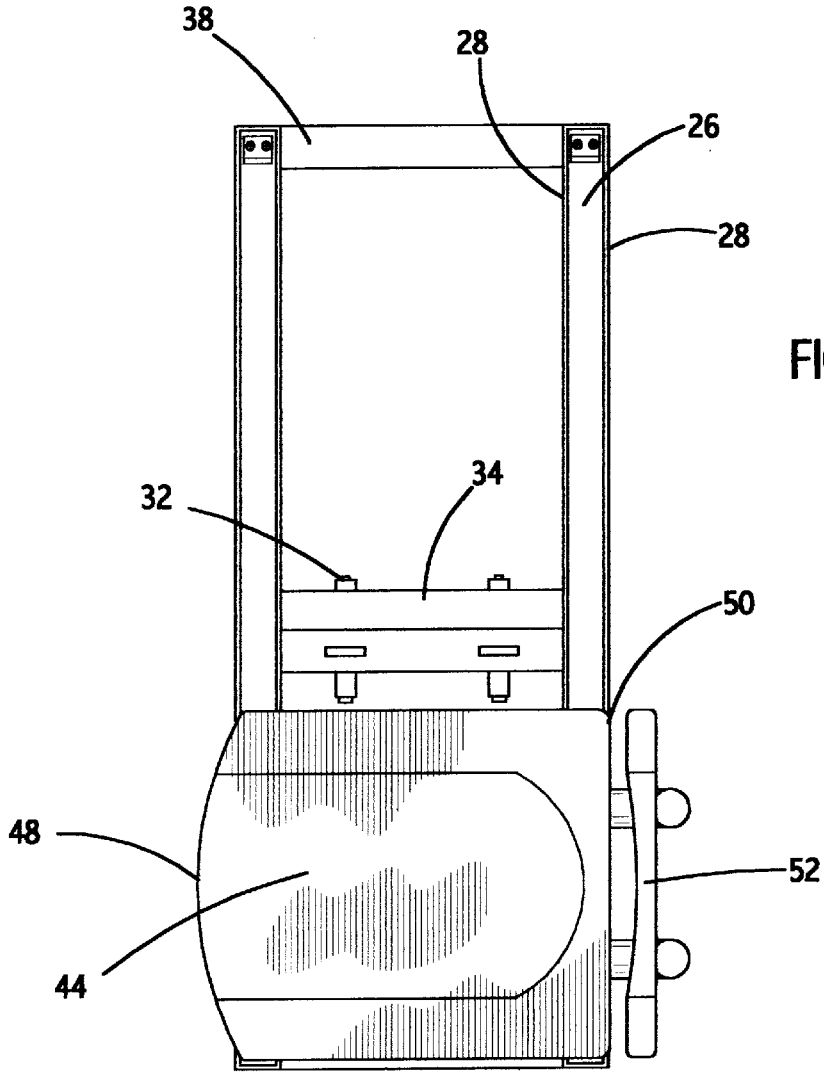
FIG. 3 is a schematic plan view of the present invention.
Figure 4:
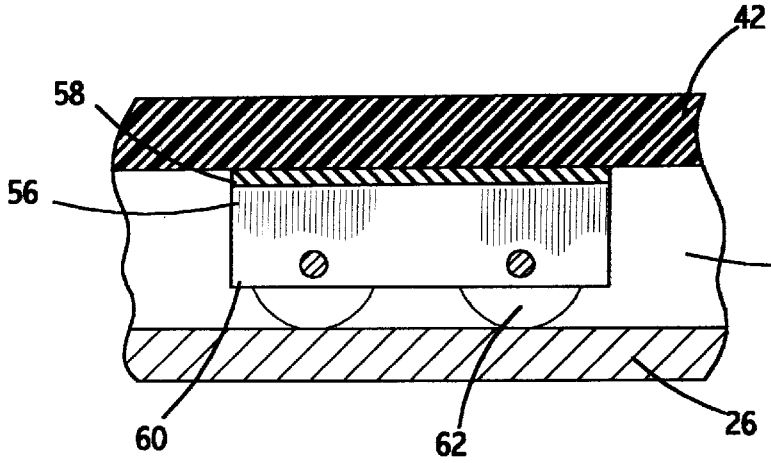
FIG. 4 is a schematic cross-sectional view taken along 4—4 of the present invention.

With reference now to the drawings, and in particular to FIGS. 1 through 4 thereof, a new bathing transfer apparatus embodying the principles and concepts of the present invention and generally designated by the reference numeral 10 will be described.

As best illustrated in FIGS. 1 through 4, the bathing transfer apparatus 10 generally comprises a pair of supports 12 for placement about a bath device or bathtub 70. The bathtub 70 has a peripheral wall having a free edge 72. Each of the supports 12 is generally U-shaped. Each of the supports has a two legs 14 and base portion 16. The base portions 16 are elongate. The supports 12 are spaced from each other. The base portions 16 of the supports are orientated generally parallel to each other such that the leg 14 extend downwardly to a floor portion. Each of the legs 14 has an end having a sole 18 thereon. Each of the soles 18 ideally comprises an elastomeric material. One of the legs 14 of each of the pair of supports 12 is placed in the bathtub 70.

A pair of rails 20 is each elongate. The rails 20 have a first end 22 and a second end 24. Each of the rails 20 has a bottom portion 26 and two side walls 28. The side walls 28 define canals in the rails 20. Each of the bottom portions 26 of the rails 20 is fixedly coupled to one of the base portions 16. Each of the side walls 28 extends upwardly away from the base portion 16. Each of the first 22 and second 24 ends of the rails 20 are located generally adjacent to one of the legs 14 of the support portions 12. The pair of rails 20 defines a track.

A plurality of stops 30 prevents movement off of the rails 20. Each of the stops 30 is fixedly mounted to the rails 30. The stops are positioned in the canals. Ideally, each of the stops 30 is generally adjacent to one of the ends 22, 24 of the rails 20. The plurality of stops 30 is preferably four stops.

A pair of securing means 32 releasably secures the support portions 12 to the free edge 72 of the bathtub 70. Each of the securing means 32 is a bracket. Each of the brackets 32 is fixedly coupled to a bar 34 extending between the pair of rails 20. Each of the brackets 32 extends downwardly away from the base portions 16 of the support members 12. Ideally, the bar 34 is slidably mounted in the rails 20, and a fastening means 36 selectively fastens the bar with respect to the rails 20. Additionally, support bars 38 may be extended between the rails 20.

A chair device 40 includes a seat portion 42. The seat portion 42 has a top side 44, a bottom side 46, a front edge 48 and a back edge 50. A back support portion 52 is fixedly coupled to the back edge 50 of the seat portion 42.

A wheel assembly rolls 54 on the rails 20. The wheel assembly 54 comprises a housing 56. The housing 56 has a top wall 58 and a bottom wall 60. The bottom wall 60 has an opening therein, and the opening has a pair of wheels 62 rotatably mounted therein. The top wall 58 is fixedly secured to the bottom side 46 of the seat portion 42. The housing 56 has width smaller than the rail 20 such that the housing 56 fits in the canal of the rail 20.

Preferably, there is a first, second, third and fourth wheel assembly. The first and second wheel assemblies are positioned generally adjacent to the back edge 50 of the seat portion 42. The third and fourth wheel assemblies are positioned generally adjacent to the front edge 48 of the seat portion 42. Each of the wheel assemblies 54 are positioned such that each of the wheels 62 has a rotational axis oriented generally perpendicular to the rails 20.

In use, the user sits on the seat portion 42 and rolls the chair device 40 to the end of the rails 20 to a point where they would like to be. The securing means 32 is slidable along the bottom portion of the rails 20 which allows for the brackets to be moved to the free edge 72 of the bath tub 70. The stops 30 prevent the user from rolling off of the rails 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A transfer apparatus for transferring a person into a bathing device, said apparatus comprising:

a pair of supports, each of said supports being generally U-shaped, each of said supports having a two legs and base portion;

a pair of rails, each of said rails being elongate, each of said rails being fixedly coupled to one of said base portions, said pair of rails defining a track;

a pair of securing means for releasably securing said pair of supports portions to the bathing device, each of said securing means being fixedly coupled to a bar extending between said pair of rails;

a chair device, said chair device comprising:

a seat portion, said seat portion having a top side, a bottom side, a front edge and a back edge;

a back support portion, said back support portion being fixedly coupled to said back edge of said seat portion; and a plurality of wheel assemblies for rolling on said rails, each of said wheel assemblies being fixedly coupled to said bottom side of said seat portion, said wheel assemblies being positioned such that said wheel assemblies are in communication with said rails.

2. The transfer apparatus as in claim 1, wherein each of said supports comprise:

said base portions of said supports being orientated generally parallel to each other such that said legs extend downwardly to a floor portion, each of said legs having an end having a sole thereon, each of said soles comprising an elastomeric material, wherein one of said legs of each of said pair of supports is placed in the bathing device in use.

3. The transfer apparatus as in claim 1, wherein each of said rails comprise:

a first end and a second end, each of said rails having a bottom portion and two side walls, said side walls defining a canal, each of said bottom portions of said rails being fixedly coupled to one of said base portions, each of said side walls extending upwardly away from said base portions.

4. The transfer apparatus as in claim 3, further comprising:

a plurality of stops, each of said stops being fixedly mounted to said rails, each of said stops being positioned in said canals, each of said stops being generally adjacent to one of said ends of said rails.

5. The transfer apparatus as in claim 4, wherein each of said wheel assemblies comprises:

said wheel assembly comprising a housing, said housing having a top wall and a bottom wall, said bottom wall having an opening therein, said opening having a pair of wheels rotatably mounted therein, said top wall being fixedly secured to said bottom side of said seat portion, said housing having width smaller than said rail.

6. A transfer apparatus for transferring a person into a bathing device, the bath device being a bathtub, the bathtub having a peripheral wall having a free edge, said apparatus comprising:

a pair of supports, each of said supports being generally U-shaped, each of said supports having a two legs and base portion, said base portions being elongate, said supports being spaced from each other, said base portions of said supports being orientated generally parallel to each other such that said legs extend downwardly to a floor portion, each of said legs having an end having a sole thereon, each of said soles comprising an elastomeric material, wherein one of said legs of each of said pair of supports is placed in the bath tub in use;

a pair of rails, each of said rails being elongate, each of said rails having a first end and a second end, each of said rails having a bottom portion and two side walls, said side walls defining a canal, each of said bottom portions of said rails being fixedly coupled to one of said base portions, each of said side walls extending upwardly away from said base portions, each of said first and second ends of said rails being located generally adjacent to one of said legs of said support portions, said pair of rails defining a track;

a plurality of stops, each of said stops being fixedly mounted to said rails, each of said stops being positioned in said canals, each of said stops being generally adjacent to one of said ends of said rails, said plurality of stops being four stops;

a pair of securing means for releasably securing said pair of supports portions to the free edge of the bathtub, each of said securing means being a bracket, each of said brackets being fixedly coupled to a bar extending between said pair of rails, each of said brackets extending downwardly away from said base portions;

a chair device, said chair device comprising:

a seat portion, said seat portion having a top side, a bottom side, a front edge and a back edge;

a back support portion, said back support portion being fixedly coupled to said back edge of said seat portion;

a wheel assembly for rolling on said rails, said wheel assembly comprising a housing, said housing having a top wall and a bottom wall, said bottom wall having an opening therein, said opening having a pair of wheels rotatably mounted therein, said top wall being fixedly secured to said bottom side of said seat portion, said housing having width smaller than said rail; and wherein there is a first, second, third and fourth wheel assembly, said first and second wheel assemblies being positioned generally adjacent to said back edge of said seat portion, said third and fourth wheel assemblies being positioned generally adjacent to said front edge of said seat portion, each of said wheel assemblies being positioned such that each of said wheels has a rotational axis oriented generally perpendicular to said rails.

* * * * *